United States Patent [19]

Bruno

[11] Patent Number: 4,846,586

[45] Date of Patent: Jul. 11, 1989

[54] RECLOSEABLE PLASTIC BAG HAVING DOUBLE THICKNESS FLAP AT OPENABLE END

[76] Inventor: Edward C. Bruno, 15336 Penwood Pl., Aurora, Colo. 80015

[21] Appl. No.: 904,936

[22] Filed: Sep. 8, 1986

[51] Int. Cl.[4] ..... B65D 33/14; B65D 33/24

[52] U.S. Cl. ..... 383/9; 383/35; 383/65; 383/87; 383/95

[58] Field of Search ..... 383/7, 9, 35, 63, 64, 383/65, 87, 95

[56] References Cited

U.S. PATENT DOCUMENTS

| | | | |
|---|---|---|---|
| 2,823,720 | 2/1958 | Svec et al. | 383/65 |
| 2,878,849 | 3/1959 | Lingenfelter et al. | 383/63 |
| 3,347,298 | 10/1967 | Ausnit et al. | 383/65 |
| 3,632,029 | 1/1972 | Sonner | 383/95 |
| 3,640,450 | 2/1972 | Lieberman | 383/35 |
| 3,960,314 | 6/1976 | Faiers | 383/87 |
| 4,015,771 | 4/1977 | Sengewald | 383/87 |
| 4,290,467 | 9/1981 | Schmidt | 383/65 |
| 4,363,345 | 12/1982 | Scheibner | 383/65 |
| 4,561,109 | 12/1985 | Herrington | 383/65 |
| 4,682,366 | 7/1987 | Ausnit | 383/35 |

*Primary Examiner*—Stephen P. Garbe

*Attorney, Agent, or Firm*—Wallenstein Wagner Hattis & Strampel, Ltd.

[57] ABSTRACT

Recloseable plastic bags having mating interlocking profiles; the bags each include a band of double thickness, formed adjacent the mouth of the bag and a pocket formed by the band and the panel surface of the bag to facilitate handling of the bag such as by inserting the user's finger in the pocket and grasping the band.

4 Claims, 2 Drawing Sheets

FIG. 1
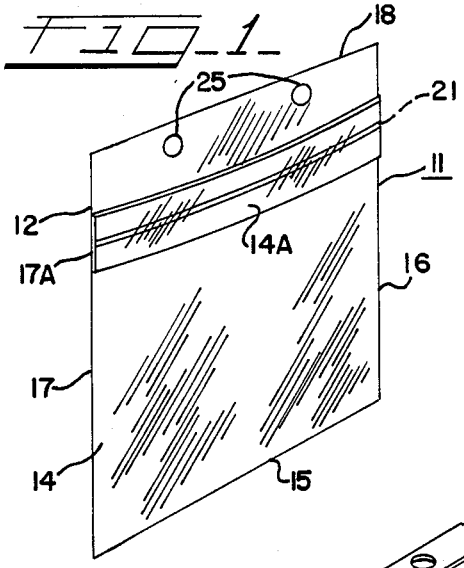
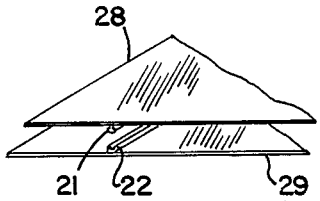
FIG. 2
FIG. 3
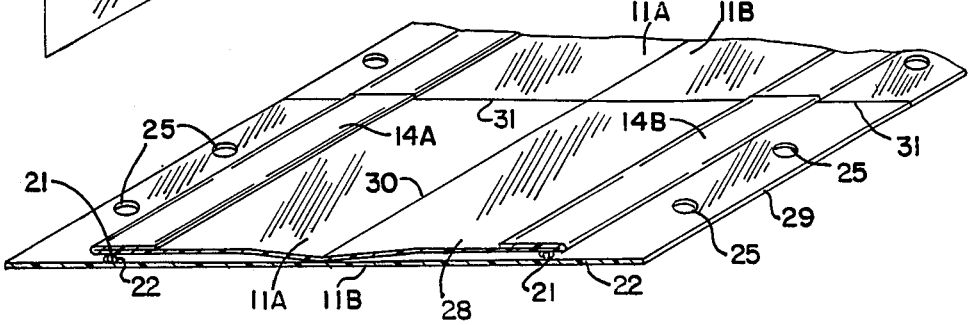
FIG. 4
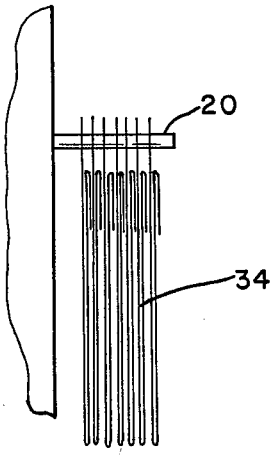
FIG. 5
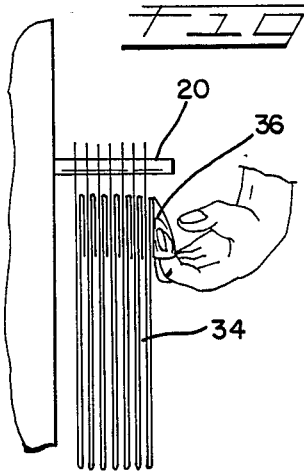

52
51
11C
46
44A
25
45
42A
42
17A
47
44
40
53B
53A
60
61
42A
44A
11D
75
73
72
77
70
69
76
71

RECLOSEABLE PLASTIC BAG HAVING DOUBLE THICKNESS FLAP AT OPENABLE END

DESCRIPTION

1. Technical Field

The present invention relates to plastic bags with recloseable mating profiles having a folded portion at the openable end, and also to a simplified method of producing such plastic bags.

2. Background of the Invention

Reclosable plastic bags are well known in the art. Their use is extensive as containers for all types of products.

The type of plastic bag to which the present invention pertains is generally disclosed in expired U.S. Pat. 3,380,481 entitled "Closed Tube with Fastener Members" issued to O. K. Kraus, to U.S. Pat. No. 3,106,941 entitled "Method of Fabricating Articles From Plastic and the Article Formed Thereby" to Plummer, and to many other U.S. and foreign patents. Plummer discloses the concept of making an interlocking tubular section from flat stock. Kraus discloses bags made from thin sheet stock initially extruded as a tube including interlocking profiles, which tube is slit and formed into flat stock, which is then formed into bags.

In the prior art, for example U.S. Pat. No. 3,106,941, a thin sheet of tubular stock material is extruded as a tube and is formed with one or more continuous ribs and spaced grooves on the wall of the tube. The tube is slit to form the flat sheets; then the ribs and grooves are interlocked, and the sheet is severed and sealed at periodically spaced points to form the individual recloseable bags having closed sides and bottom and an openable top. In use, the bags may be opened and closed repeatedly.

SUMMARY OF THE INVENTION

Applicant has found that it is advantageous to provide a bag wherein the openable end of the bag includes a folded portion and/or a flap to strengthen the bag opening or mouth and to withstand repeated use without tearing. Further, the construction of the preferred embodiment of the present bag enables a user such as a packer on a product packing line to easily and conveniently pull a bag for use from a bag mounting stack by inserting his finger in the pocket formed between the double thickness flap.

In one alternative embodiment of the invention, bags are formed to have initially open, or non-interlocked tops, which provide certain advantages to the users. One principal advantage of the open top bag is that a user, for instance a packer in a packing line, gets an already open bag, thereby eliminating the extra step of opening the bag in the product packing process.

Applicant also provides an improved method for making a plurality of folded flap open profile bags concurrently. The method of making the bags involves the provision of a flat, continuous thin sheet of plastic material having parallel lateral edges and with interlocking mating profiles, that is, rib (tongue) and groove profiles formed on one surface of the sheet. A second similar sheet, but of smaller width and also having rib and groove element formed on one surface of the sheet, is centrally overlaid on the first sheet with the male profile of the sheet adjacent the female profile of the other sheet. The two sheets are then sealed, scored and severed in a pattern to form the bags. The first sheet forms an extended flap such as for stack mounting.

Further features and advantages of the present invention will become apparent from the following description, claims and drawings.

DESCRIPTION OF THE DRAWINGS

FIG. 1 is an isometric view of the inventive bag;

FIG. 2 is an isometric cutaway portion of the two facing sheets prior to the point where one of the sheets is folded to form the flap of FIG. 1;

FIG. 3 shows the process of folding the sheet to form the flap, and the forming of the individual bags by making a longitudinal seal or seam to form the closed bottom of the bag, and the spaced periodic transverse seals or seam to form the sides of the bags.

FIG. 4 shows the stack mounting of the bags of FIG. 4; and

FIG. 5 shows a method of removing the bags from the stack for use such as by a packer.

FIGS. 8(*a*), 8(*b*) and 8(*c*) show the method and steps of forming the bag of FIG. 6 from the flat sheet of FIG. 7;

DETAILED DESCRIPTION OF THE INVENTION

Figures 6, 7, 8A, 8B, 8C, 9, 10, 11:
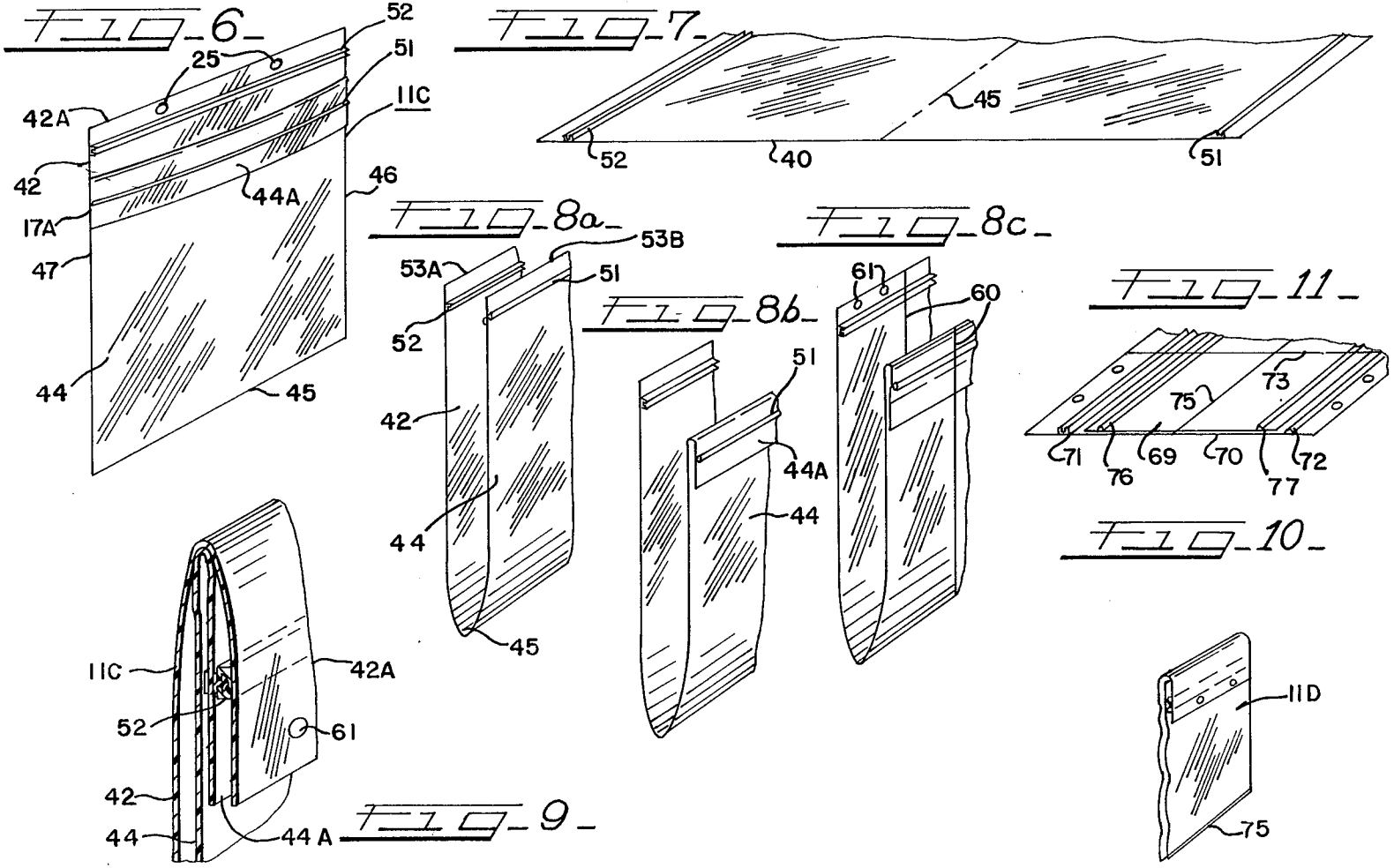
FIG. 6 is an isometric view of an alternative embodiment of the inventive bag.
FIG. 7 shows the flat sheet stock from which the bag of FIG. 6 may by formed.
FIG. 9 shows a relatively enlarged view of the bag of FIG. 6 to show the folded over or closed bag with the profiles interlocked.
FIG. 10 shows another embodiment of the inventive bag.
FIG. 11 shows a method for making the embodiment of the inventive bag of FIG. 10.

FIG. 1 shows the inventive recloseable bag 11 comprising two panels 12 and 14 formed of two separate sheets and electronically or heat sealed, as is well known, to form the bottom seam or bottom 15 of bag 11. The panels 12 and 14 are further electronically or heat sealed as at 16 and 17 to form the sides of bag 11. Panel 12 extends upwardly of panel 14 to form a mounting flap 18 for bag 11. Panels 12 and 14 include facing interlocking profiles 21 and 22, i.e., a tongue or rib 21 and a groove 22, which are interlocked or closed by the tongue and groove together as is well known (see also FIG. 2). The bag 11 may be opened by pulling the panels apart. The top portion of panel 14 is folded over on itself as a band 14A which is sealed at the sides of panel 14 as at 17A.

The top of panel 12 or flap 18 has holes 25 formed therein for mounting the bags 11 as on a peg 20 as shown in FIG. 4.

Refer now to FIGS. 2 and 3 which show the structure of the inventive bag and also depict the method of making the bag. FIGS. 2 and 3 comprise a pair of elongated flat sheets 28 and 29 of plastic material such as ½ mil polyethylene or polyurethane. The sheets are extruded with mating profiles 21 and 22 extending along the length of the sheets and formed on one surface of the sheets. The profiles 21 and 22 are formed on respective edges of the sheets.

FIG. 2 depicts a first step of making the bags and consists of overlaying the elongated continuous sheets 28 and 29 over one another with the profiles 21 and 22 in facing alignment with one another. The sheet 28 then has the portions adjacent its edges folded on itself to form the bands 14A and 14B. The sheets are next fed such through suitable rollers or rods to press and force the profiles to interlock or close. Concurrently, a longitudinal seal or seam 30 is formed along the center of the sheets by suitable known means, to form the bottom or bottom seam 15 of the bags 11. Also at spaced periodic points along the sheet, as at 31, transverse seals or seams are formed by suitable known means to provide the sides 16 and 17 of the bags and also to provide a sever line for the individual bags. Note that two bags referred to individually as 11A and 11B in FIG. 3 are formed concurrently by the foregoing method.

Holes 25 are formed by suitable known means on the non-folded edge of sheet 29 to permit mounting or stacking the individual bags on a peg 20 as indicated in FIG. 4.

Each of the bags 11A and 11B will have bands such as 14A and 14B, which provide a reinforced edge on the open end of the bag to resist tearing of the bag as it is handled, particularly in opening and reclosing the bag. Importantly, the bands 14A and 14B also form a small pocket or finger flap 36, as indicated in FIG. 5, to enable a user such as a packer in a packing line to insert his finger to easily and conveniently remove an individual bag 11 from the stack on the mounting peg.

FIG. 6 shows another embodiment of inventive recloseable plastic bag 11C formed of two panels 42 and 44 formed of an integral sheet 40 folded at the bottom 45 (see also FIGS. 8*a*, 8*b* and 8*c*) and sealed along the side edges 46 and 47. Panel 42 of bag 11C extends upwardly of panel 44 to form a fold over flap 42A, as will be explained hereinbelow with reference to FIG. 9. The flap 42A and panel 44 include interlocking profiles 51 and 52, similar to profiles 21 and 22 of bag 11C. Panel 44 is folded over on itself as a band 44A which is sealed as by heating or electronic means to the side of panel 44. The bag 11C is closed by the user by folding flap 42A over panel 44, aligning the profiles 51 and 52, and applying sliding finger pressure to force the profiles together. The bag 11C is opened by pulling the profiles 51 and 52 apart.

Refer now to FIGS. 7 and 8*a*, 8*b* and 8*c*, which show the structure of the inventive bag 11C and also depict the method of making the bag.

FIG. 8(a) shows the first step of making the bag 11C and consists folding the sheet along its center line 58 to form a U-fold with sides 42 and 44 (which subsequently form the panels 42 and 44) and with the profiles 51 and 52 on the inside surface of the fold. The lateral edges 53A and 53B are aligned with each other.

FIG. 8(*b*) shows the next step of folding the upper band 44A of the U-fold outwardly to position the profile 51 on the outside surface of panel 44. Next, as shown in FIG. 8(*c*), the panels 42 and 44 and band 44A are pressed together and welded or sealed together by known heat or electronic means at periodically spaced transverse intervals, as at 60, to form the side edges 46 and 47 of individual bags 11C of FIG. 6. Holes 61 are formed on flap 42A at any desired stage of the manufacturing process for hanging the bags 11C on suitable pegs for dispensing as indicated in FIG. 4.

When the user gets the bag 11C, the bag 11C is open, that is, the profiles 51 and 52 are not joined or interlocked. After the user fills the bag 11C with the desired product, the user can conveniently fold the flap 42A over and close or lock the mating profiles 51 and 52 together, as shown in FIG. 9. It has been found that this closing function is conveniently accomplished by folding the flap 42A over the band 44A, manually aligning the profiles 51 and 52, and then by applying finger pressure, forcing the profiles 51 and 52 into locking engagement.

As will be appreciated, the bags 11A, 11B and 11C provide a strong openable end or mouth. Thus, the section of the bag 11A in which the profiles are formed, and the section which takes considerable use and abuse due to the opening and closing of the bag 11, is relatively heavily reinforced. Also the open edge of the bags 11A, 11B and 11C is folded or rolled over, which adds to the strength of the panel forming the bag. Further, the folded over edge is visually apparent and indicates to the user the mouth or recloseable end of the bags.

It should be noted that the flat continuous sheet of stock material of FIG. 7 may be extruded from a linear extruder, or the sheet of material may be extruded as a tube and then severed longitudinally as disclosed in the U.S. Pat. No. 3,380,481 to Kraus, cited above.

Bag 11D of FIG. 10, which is another embodiment of the inventive bag, is formed of two sheets 69 and 70, which are heat sealed to form the side edges of the bag and also along the lower edge to form a bottom weld or seal.

The method of making the bag 11D, as shown in FIG. 11 is to provide a first sheet 70 with a tongue and groove profile 71 and 72 substantially as on sheet 40 of FIG. 7. Next, a similar but relatively more narrow sheet 69 also with two profiles 76 and 77 thereon is centrally overlayed over sheet 70. The profiles 51, 52 and 72, 77 of both sheet 69 and 70 face in the same direction (upwardly) as shown in FIG. 11. Note that tongue or male profile 76 of sheet 69 is positioned in adjacent parallel relation to groove or female profile 71 of sheet 70. Thus the tongue profile of one sheet is mateable or interlockable with the groove profile of the other sheet. The two sheets 69 and 70 are then electronically or heat sealed, similar as shown in FIG. 3 together along a central elongated line 75. During a concurrent operation, the elongated sheets 69 and 70 are sealed and scored or severed at periodic transverse intervals as at 73 to form the side edges for the individual bags 11D. Two bags 11D are thus made at the same time.

While the invention has been particularly shown and described with reference to a preferred embodiment thereof, it will be understood by those skilled in the art, that various changes in form and details be made therein without departing from the spirit and scope of the invention.

I claim:

1. An openable and recloseable plastic bag formed of thin plastic sheet, said bag comprising first and second panels joined along the sides and having an open mouth, said first panel having a first mating interlocking profile formed thereon, said second panel having a second mating interlocking profile formed thereon, a band extending from side to side of said second panel, said second interlocking profile of said second panel extending in parallel relation to said band and whiting the boundaries of said band, said band having the ends thereof which are joined to said second panel to form a pocket defined by said band and the surface of said second panel to enable a user to insert an object, such as a finger, therein to grasp the bag, said first panel having a portion extending upwardly of said band and wherein holes are formed on said upwardly-extending portion of said first panel to enable mounting said bag, such as on a peg, for dispensing therefrom.

2. A bag as defined in claim 1, in which said first and second mating interlocking profiles are positioned on said panels in confronting relation to each other.

3. a bag as defined in claim 1, in which said first mating interlocking profile is formed on said portion of said first panel and said second mating interlocking profile is formed on an exposed surface of said band.

4. A bag as defined in claim 1, in which said first and second panels are formed a single sheet folded intermediate opposite edges to form a bottom edge for said bag.

* * * * *